United States Patent [19]

Noda et al.

[11] Patent Number: 4,647,233

[45] Date of Patent: Mar. 3, 1987

[54] THERMAL PRINTER

[75] Inventors: Atsushi Noda; Takayoshi Hanakata, both of Yokohama, Japan

[73] Assignee: Canon Kabushiki Kaisha, Tokyo, Japan

[21] Appl. No.: 851,862

[22] Filed: Apr. 10, 1986

Related U.S. Application Data

[60] Continuation of Ser. No. 496,211, May 19, 1983, abandoned, which is a continuation of Ser. No. 204,007, Oct. 31, 1980, abandoned, which is a division of Ser. No. 16,984, Mar. 2, 1979, abandoned.

[30] Foreign Application Priority Data

| | | | |
|---|---|---|---|
| Mar. 8, 1978 | [JP] | Japan | 53-26184 |
| Mar. 9, 1978 | [JP] | Japan | 53-27048 |
| Mar. 9, 1978 | [JP] | Japan | 53-27049 |
| Mar. 9, 1978 | [JP] | Japan | 53-27050 |
| Mar. 9, 1978 | [JP] | Japan | 53-27055 |
| Mar. 9, 1978 | [JP] | Japan | 53-27056 |
| Mar. 9, 1978 | [JP] | Japan | 53-27057 |
| Apr. 13, 1978 | [JP] | Japan | 53-43508 |

[51] Int. Cl.[4] ..... B41J 3/20; B41J 29/58

[52] U.S. Cl. ..... 400/120; 400/54; 400/356; 400/600.2; 400/668

[58] Field of Search ..... 400/120, 54, 171, 320, 400/322, 636.1, 356, 613, 600.2, 664, 668, 187, 616.3; 346/76 PH

[56] References Cited

U.S. PATENT DOCUMENTS

| | | | |
|---|---|---|---|
| 2,486,985 | 11/1949 | Ruderfer | 400/120 |
| 3,001,470 | 9/1961 | Nessel | 400/600.2 |
| 3,543,905 | 12/1970 | Albrile | 400/54 |
| 3,810,192 | 5/1974 | Okabe | 346/76 PH |
| 3,845,850 | 11/1974 | Herr et al. | 346/76 PH |
| 3,935,936 | 2/1976 | Wilczewski | 400/54 |
| 4,013,159 | 3/1977 | Okabe | 400/120 |
| 4,030,587 | 6/1977 | Walker | 400/322 |
| 4,088,867 | 5/1978 | Levene | 400/120 X |
| 4,113,391 | 9/1978 | Minowa | 400/120 |
| 4,124,312 | 11/1978 | Johnson | 400/320 |
| 4,184,781 | 1/1980 | Ota | 400/54 |
| 4,196,666 | 4/1980 | Kobayashi et al. | 400/146 |
| 4,310,255 | 1/1982 | Asano et al. | 400/171 |
| 4,326,813 | 4/1982 | Lomicka et al. | 400/322 |
| 4,421,428 | 12/1983 | Noda et al. | 400/120 |
| 4,544,287 | 10/1985 | Teraoka | 400/356 |

FOREIGN PATENT DOCUMENTS

| | | | |
|---|---|---|---|
| 2517766 | 10/1976 | Fed. Rep. of Germany | 400/54 |
| 2525263 | 10/1976 | Fed. Rep. of Germany | 400/54 |

*Primary Examiner*—William Pieprz

*Attorney, Agent, or Firm*—Fitzpatrick, Cella, Harper & Scinto

[57] ABSTRACT

The present invention relates to a thermal printer comprising a thermal head, and means for inhibiting an energization signal for heat generation of said thermal head. The inhibition means prevents the thermal head from being energized when it is in a non-operational position thereby preventing damage to the thermal head.

3 Claims, 29 Drawing Figures

THERMAL PRINTER

This application is a continuation of application Ser. No. 496,211 filed May 19, 1983, now abandoned, which in turn is a continuation of Ser. No. 204,007, filed Oct. 31, 1980, now abandoned, which in turn is a division of Ser. No. 16,984, filed Mar. 2, 1979, now abandoned.

BACKGROUND OF THE INVENTION

1. Field of the Invention

The present invention relates to a printing apparatus such as thermal printer.

2. Description of the Prior Art

In thermal printer there is widely used such kind of heat sensitive paper coated with a substance which is able to develop color under the action of heat.

However, use of such heat sensitive paper in thermal printing involves the following disadvantages:

A. Only one sheet of record is obtainable.

B. A careful preservation of recording paper is required. The recording paper is apt to easily develop color under a high temperature condition or by contact with chemicals such as alcohol, thinner and the like.

C. Printed characters or recorded images become faded when exposed to direct sunlight or contacted with plasticizer such as that of vinyl chloride for a long time.

In order to solve the problem of A, that is, the disadvantage that only one sheet of record is obtainable, a combination of two or more sheets of heat sensitive paper has been already proposed. An example of such combination is shown in FIG. 1. As seen there, two sheets of heat sensitive paper SP1 and SP2 are adhered together. By separating the two sheets SP1 and SP2 after printing there are obtained two sheets of record. However, this solution concerns the problem A only. Other problems of B regarding the preservation of record and C regarding fading remain unsolved. Rather, for such combination of sheets of heat sensitive paper, there arise the following new problems:

D. A close adhesion of the second sheet to the first sheet should be assured. Otherwise, a thin print is obtained on the second sheet.

E. Because of the close adhesion, it is not easy to separate the two sheets.

Since these two problems are contradictory ones, it is very difficult to find an effective solution which can solve the above two problems at the same time. A known system proposed to solve the problems is shown in FIG. 2. This system is featured by the fact that the first sheet SP is a sheet of heat sensitive paper the backside surface of which is coated with a layer of heat fusible ink T and the second sheet PP is of a mere common paper. This system has many advantages as compared with the first mentioned one.

First of all it is no longer necessary to stick the sheets together. Secondly, the pressure required to effect printing on the two sheets by pressing the thermal head against the platen through the sheets need not be so large. A pressure nearly equal to that required to effect printing on one single sheet is sufficient to make clear prints on the two sheets. Thirdly, it has no problem in respect to heat transmission since printing on the second sheet is effected by fusing and transferring the ink coated on the backside of the first sheet.

FIG. 3 illustrates the manner of printing in accordance with the method. Designated by 1 is a thermal head. 2 is a sheet of heat sensitive paper which constitutes the first sheet in this system. When dots 1' on the thermal head 1 generate heat, a chemical reaction takes place in a heat sensitive layer 2' coated on the upper surface of the sheet 2 so that the layer develops color. At the same time, heat is transmitted to the backside of the sheet to fuse the ink 2''. 3 is a simple common paper which constitutes the second sheet of paper in this system. The pressure applied by the thermal head 1 keeps the two sheets 2 and 3 in a state of close contact with each other and therefore the fused ink 2'' is sandwiched in between the two sheets. When the heat generation of the thermal head ends, the ink hardens. The two sheets come out with their printed portions being adhered together by the ink. Since unprinted portions of the two sheets remain separated from each other, the separation of the two sheets after printing can be done very easily. Usually, the backside surface of the first sheet 2 is pretreated, for example, by coating it with wax and the like prior to coating with the layer of ink 2'' so as to assure an easy separation of the ink layer from the first sheet after printing. Therefore, at the time of the two sheets being separated after printing, the fused portions of the ink layer are easily transferred onto the second sheet 3.

As will be clearly understood from the foregoing, with the improved system of combination of printing papers, the above mentioned problems D and E involved in the first mentioned type of combination of printing papers are completely solved. Moreover, as far as the second sheet is concerned, other problems of fading and preservation as previously mentioned also can be solved. This is because the composition of the ink used in this system is almost the same as that of inks widely used in carbon paper and the like which has no problem of fading. Even when the print is left under a condition of high temperature, no gradation occurs. On the contrary, the record on the sheet becomes much more stable since the ink is refused and sinks in the paper thoroughly under a condition of high temperature.

FIGS. 4 and 5 show two different forms of the above described double sheet type of recording paper system. In FIG. 4 showing a roll of recording paper, 2 is a heat sensitive paper as the first sheet and 3 is a common paper as the second sheet. These two papers 2 and 3 are rolled round a common shaft and the length of web of the first paper 2 is longer than that of the second one 3, by $2\pi x$ (thickness of the paper) per round. This difference in length between the first and second papers 2 and 3 in one roll causes trouble. Since, as previously described with reference to FIG. 3, the first and second sheets 2 and 3 come out, after printing, from the area of the thermal head 1 with the printed portions adhered together by ink and with the same length, a slack is necessarily formed in the first sheet 2. When the slack becomes large, difficulty such as paper jamming is caused thereby.

FIG. 5 shows another form of the duplicate recording paper comprising the first sheet of heat sensitive paper 2 and the second sheet of common paper 3 which have a number of sprocket perforations along both sides and which are folded regularly. In this case, the length of the first sheet 2 may be the same as that of the second one. However, as well known to those skilled in the art, the size of a sheet of paper suffers a change by temperature and moisture. In the combination shown in FIG. 4 or 5, a paper coated with particular substances on both sides is used as the first sheet 2 whereas the second sheet 3 is of a bare common paper. Therefore, the difference in expansion or shrinkage between the two sheets is not small. The difference in length produced by it between the two sheets reaches often the order of 1 mm per 30 cm in the worst case it may reach the order of 5 mm per 30 cm. This is the same for the roll type one shown in FIG. 4.

Such difference in size between the two sheets brings forth a very serious problem, in particular, for the fold type recording paper system shown in FIG. 5. If there is produced a difference in length of 1 mm per 30 cm, then, after printing by 1.2 m, the difference will increase up to 5 mm. This makes the sprocket perforations on the first sheet 2 and those on the second one 3 get out of register which may result in breaking of the paper.

SUMMARY OF THE INVENTION

Accordingly it is a general object of the present invention to eliminate the difficulties mentioned above.

It is more specific object of the invention to provide a thermal printer of the type mentioned above which enables prints to be made in two sheets at the same time without any trouble of slacking or breaking of paper.

It is a further object of the invention to provide a thermal printer in which the problem of difference in expansion or shrinkage between the two sheets is completely excluded and by which always good prints can be obtained.

Other and further objects, features and advantages of the invention will appear more fully from the following description.

DETAILED DESCRIPTION OF THE PREFERRED EMBODIMENTS

Figure 7:
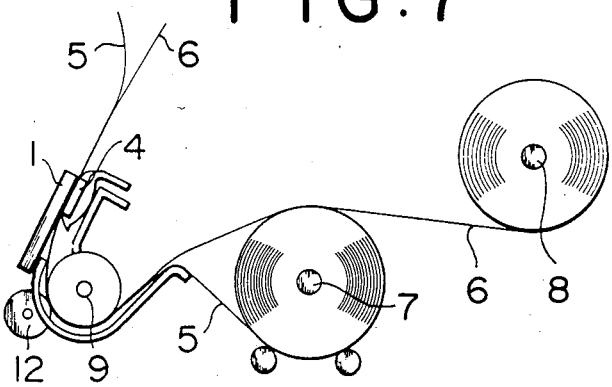
FIG. 7 is a partial sectional view thereof.
Figure 6:
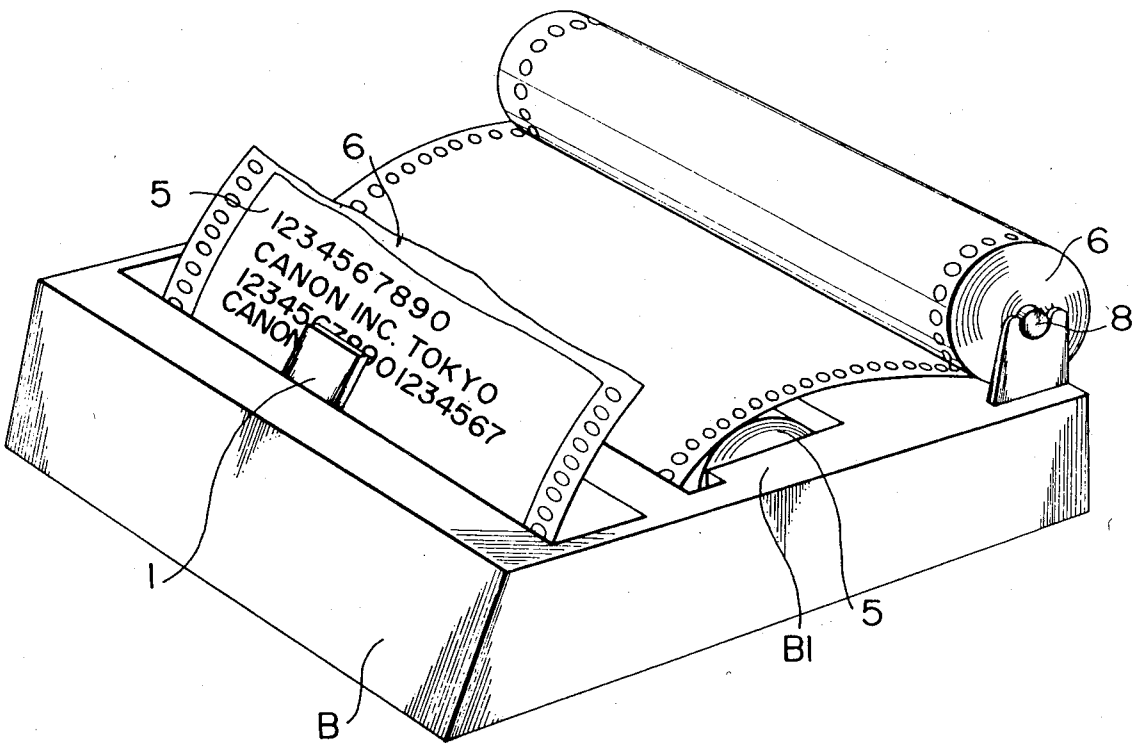
FIG. 6 is a perspective view of a printer according to the invention.

FIGS. 6 and 7 show a thermal printer according to the present invention. As previously noted, an important feature of the present invention resides in that the top heat sensitive paper and the bottom common paper which together constitute a double recording paper system are separately supplied from separate feed sources.

Figure 8:
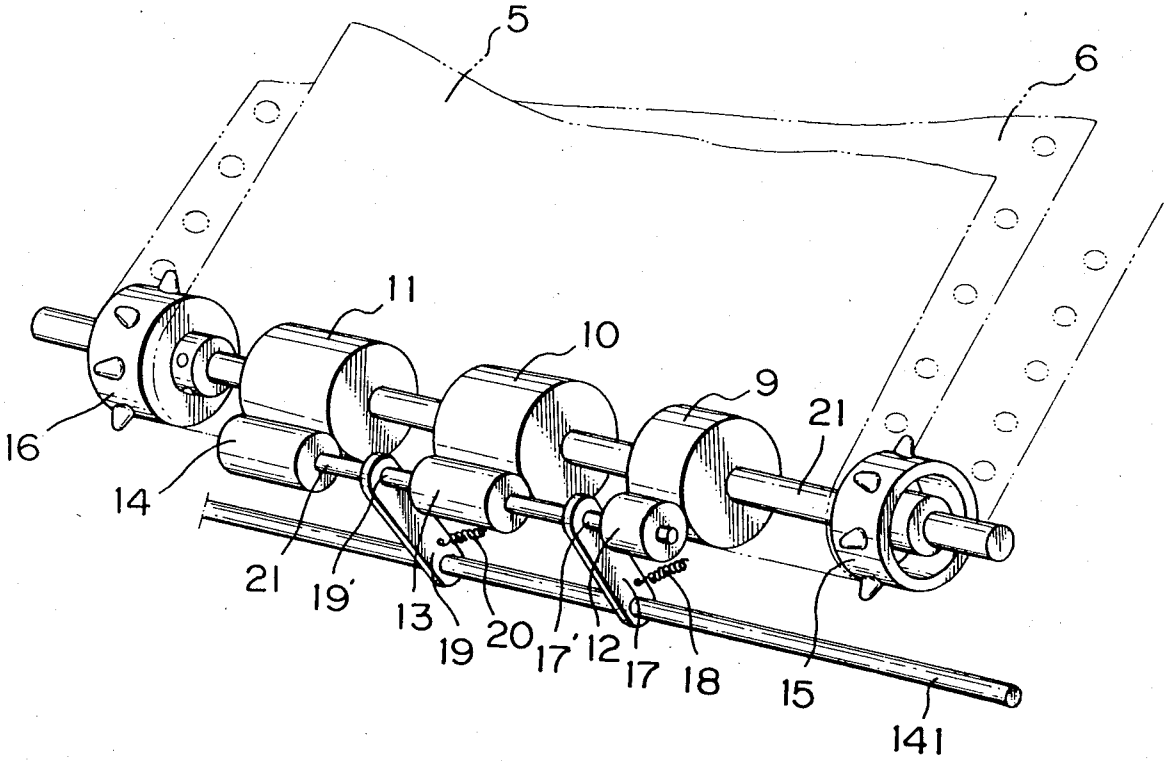
FIG. 8 is a perspective view of the paper feeding part of the printer.

In FIGS. 6 and 7, a web of heat sensitive paper having a layer of ink coated on its backside is designated by 5 and a web of common paper having a number of sprocket perforations along both side edges is designated by 6. The common paper 6 is about 25 mm larger than the heat sensitive paper 5 in the width of web. FIG. 8 shows the paper feeding mechanism in the printer. During feeding, the position limiting part (or guide) B1 formed on the main body casing B keeps the heat sensitive paper 5 in a predetermined position as shown in FIG. 6. Rubber rollers 9, 10 and 11 and pinch rollers 12, 13 and 14 shown in FIG. 8 constitute paper driving means. The shaft 7 of a supply roll of the heat sensitive paper 5 is positioned sufficiently close to the paper driving means 9–14 to prevent a deviation of the running course of the paper 5. The shaft 8 of a supply roll of the common paper 6 is positioned spaced from the shaft 7 of heat sensitive paper 5. Rubber rollers 9, 10, 11 and sprocket rollers 15, 16 constitute driving means for the web of common paper 6. Although the supply roll of common paper is relatively distant from the rubber rollers 9, 10, 11, the use of sprocket feed system prevents also deviation of running course of the web of common paper 6. As shown in FIG. 7, the papers 5 and 6 printed by the thermal head 1 are discharged from the printer with the printed portions of the two webs adhered together by ink. Here, note should be taken to the fact that since the two papers 5 and 6 are set independently of each other there never arises the problem of slacking of the web of top paper 5 unlike the case mentioned above with reference to FIGS. 4 and 5 showing the prior art. Another fact worthy of note is that the sprocket perforations are provided only to the bottom paper 6 and no such perforation is provided to the top paper 6. Because of that fact, the abovementioned problem that the sprocket perforations of the top paper and those of the bottom paper get out of registration due to the difference in expansion-contraction rate between the two papers is completely excluded. Thus, troubles of slacking and breaking of paper can be eliminated.

In addition, the following effects can be obtained by the present invention as a result of the feature that the supply roll of common paper is independent of that of heat sensitive paper:

(1) Any desired common paper such as report paper, ledger paper and letter paper can be used to print on it.

Figure 1:
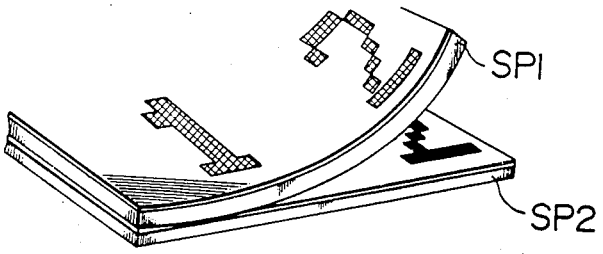
FIG. 1 PRIOR ART
FIG. 1 illustrates a double recording paper comprising two heat sensitive paper sheets adhered together according to the prior art.
Figure 2:
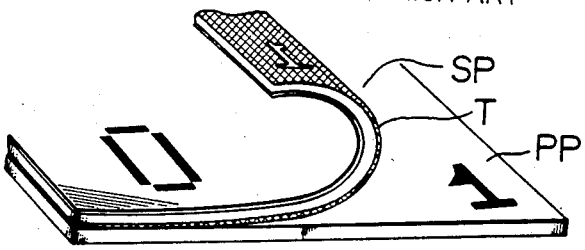
FIG. 2 PRIOR ART
FIG. 2 illustrates another type of prior art double recording paper comprising a combination of a heat sensitive paper coated with ink and a bare common paper.
Figure 3:
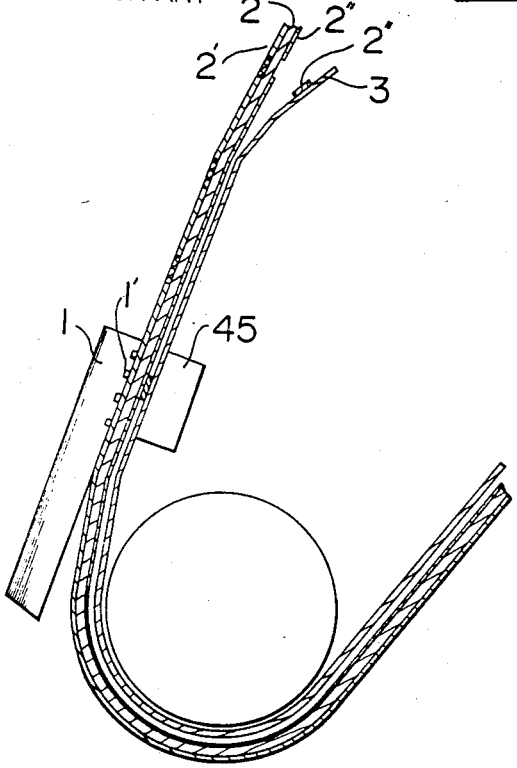
FIG. 3 PRIOR ART
FIG. 3 illustrates the manner of printing on the double recording paper shown in FIG. 2.
Figure 4:
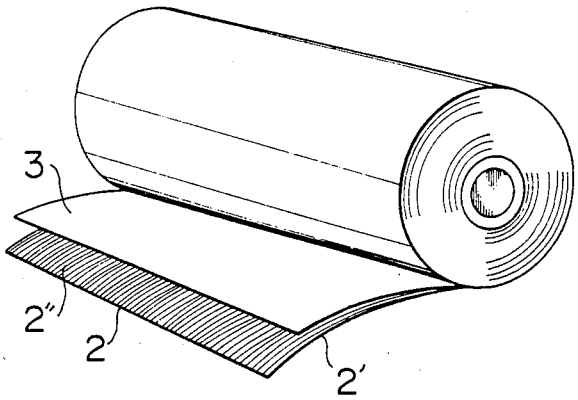
FIG. 4 PRIOR ART
FIG. 4 shows the prior art double recording paper in a form of roll and FIG. 5 shows it in a form of folded stack.
Figure 5:
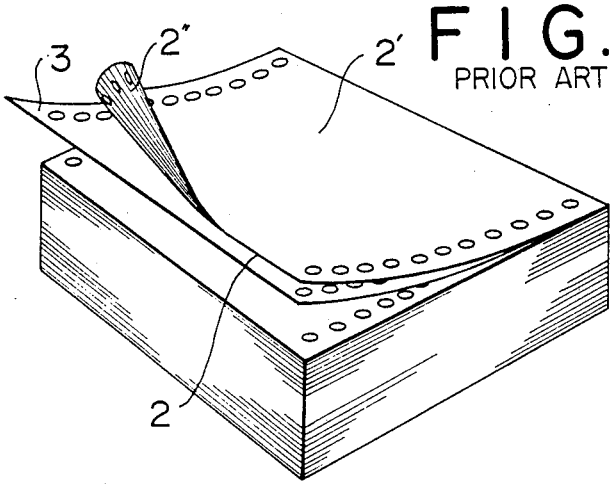
FIG. 5 PRIOR ART

(2) In case of the conventional case wherein two different papers are rolled round a common shaft as shown in FIG. 4, it is not allowable to provide sprocket perforations thereto for the reasons mentioned above. However, according to the invention, two separate supply roll shafts are provided, one for common paper and another for heat sensitive paper. The common paper has sprocket perforations as shown in FIG. 6. This enables printing of characters and figures at correct positions as indicated by a format previously printed thereon.

The present invention is also applicable, with similar effects, to such recording papers folded with perforated line along which to cut off.

As seen in FIG. 8, the pinch roller shaft is relatively small in diameter but it is able to press the three or four pinch rollers against the platen with a uniform pressure, which produces a very preferable effect on paper feeding operation.

Figure 9:
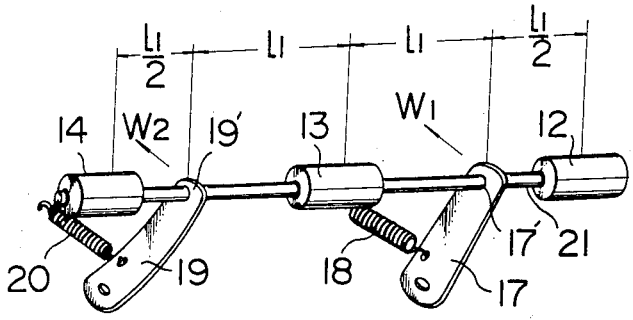
FIG. 9 illustrates the positional relation between the elements of the paper feeding part shown in FIG. 8.

Now, the paper feeding mechanism is described in detail. Pinch rollers 12, 13 and 14 are mounted on a common shaft 21 supported by two levers 17 and 19. These levers 17 and 19 are positioned between the pinch rollers and biased by coil spring 18 and 20 respectively. The forces applied to the fulcrums 17' and 19' are $W_1$ and $W_2$ respectively (See FIG. 9). Since the two levers have the same shape and also the two springs are entirely the same as each other, $W_1=W_2$. The fulcrums 17' and 19' are, as seen in FIG. 9, positioned somewhat distant outwardly from the middle point between two pinch rollers 12 and 13 and that between 13 and 14 on the shaft 21 respectively.

The positions of fulcrums 17' and 19' are so determined that the force applied to the pinch roller 12 by the lever 17 is $W_1\times\frac{2}{3}$ and that to the pinch roller 13 is $W_1\times\frac{1}{3}$ whereas the force applied by the other lever 19 is $W_2\times\frac{1}{3}$ to the pinch roller 13 and $W_2\times\frac{2}{3}$ to the pinch roller 14. Thus, the forces with which the three pinch rollers 12, 13 and 14 press the rubber rollers 9, 10 and 11 respectively are all the same and equal approximately. Therefore, with this arrangement of the paper feeding mechanism in accordance with the invention, the middle pinch roller 13 is kept in the position without its being raised although the shaft 21 having a relatively small diameter is used. This is different from the case of prior art shown in FIG. 10. In case of the arrangement shown in FIG. 10, the shaft 21 is curved by the forces applied to both ends of the shaft and therefore the middle pinch roller 13 is apt to rise departing from its working position.

Figure 10:
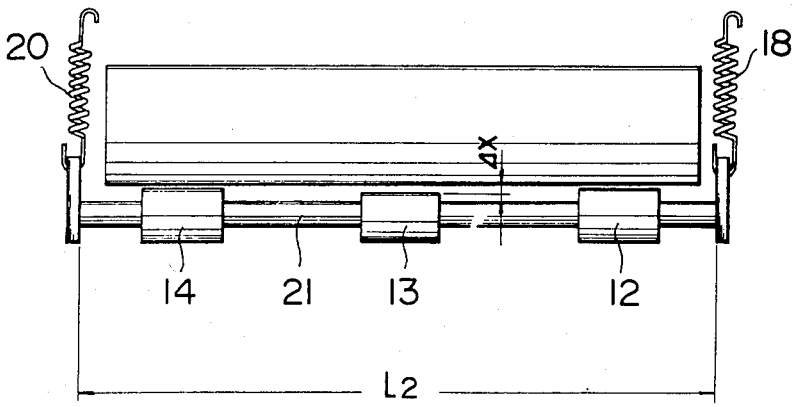
FIG. 10 PRIOR ART
FIG. 10 illustrates the positional relation in the prior art printer.

In general, the bend $\Delta x$ of shaft becomes larger with the increase of forces of springs 18, 20, with the decrease of diameter of shaft 21 and with the increase of the shaft length $l_2$. Since the springs 18, 20 must have sufficiently large force to satisfy the requirement, the shaft 21 is required to have a large diameter to minimize the bending of the shaft. For this reason, hitherto, a shaft large in diameter was used as the shaft 21. However, use of the shaft 21 having a large diameter has various drawbacks. It has a large inertial mass and is therefore unsuitable for high speed driving system. Moreover, it is expensive. Particularly, in case of a typewriter, the shaft must have a relatively large length. Therefore, in this case, it is very difficult to eliminate the problem of rising of the middle pinch roller. With the prior art arrangement as shown in FIG. 10, it has been impossible to feed paper uniformly even when a large diameter of the shaft 21 was used. On the contrary, the arrangement in accordance with the invention shown in FIG. 9 can assure a uniform distribution of force even when the overall length of the shaft is relatively large.

Figure 11:
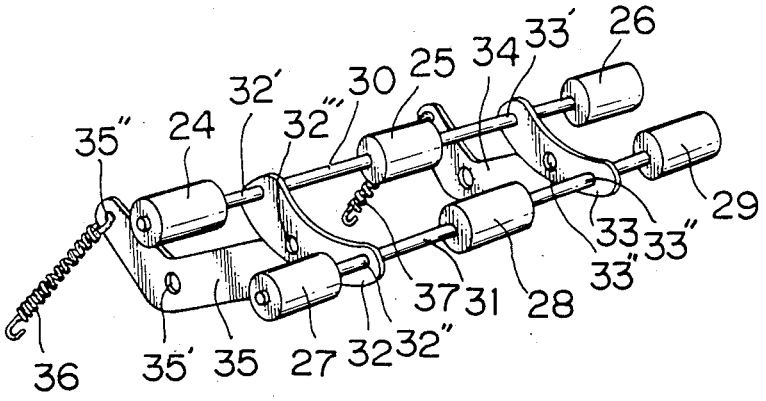
FIG. 11 is a view similar to FIG. 8 but showing another arrangement of paper feeding mechanism.
Figure 12:
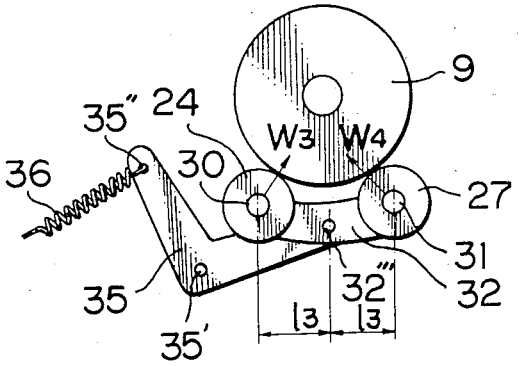
FIG. 12 is a cross section thereof.

A further improvement of paper feeding mechanism can be attained by another embodiment shown in FIGS. 11 and 12.

It is known that the correctness of paper feeding using rubber roller can be improved by arranging pinch rollers at two different positions on the circumference of the rubber roller. According to the invention, six and more pinch rollers can be uniformly pressed against the platen with an even pressure.

In FIG. 11, a shaft 30 with three pinch rollers 24 to 26 and another shaft 31 with three pinch rollers 27 to 29 are shown. The shaft 30 has fulcrums at 32' and 33' and the shaft 31 has fulcrums at 32'' and 33''. These fulcrums have the same positional relation as shown in FIG. 9. The arm 32 having the fulcrums 32' and 32'' has one more supporting point 32''' about which the arm is rotatable relative to a lever 35. The lever 35 is formed as angle lever and is swing movable about 35'. At one end of the angle lever 35 is anchored one end of a spring 36.

As seen in FIG. 12, the force of the spring 36 is applied to the supporting point 32''' through the lever 35. The two fulcrums 32' and 32'' on the arm 32 are equally distant ($l_3$) from the point 32'''. Therefore, the force $W_3$ with which the pinch roller 24 presses the rubber roller 9 is always equal to the force $W_4$ with which the pinch roller 27 presses the rubber roller 9.

Another set of arm 33, lever 34 and spring 37 shown in FIG. 11 corresponds to that of the above described arm 32, lever 35 and spring 36 in shape and arrangement. Thsu, the two springs 36 and 37 apply their force to six pinch rollers in total and these pinch rollers press the platen 37. Even when the shafts 30 and 31 are considerably small in diameter and large in length, the pressing force by the six pinch rollers is kept uniform always.

Figure 13:
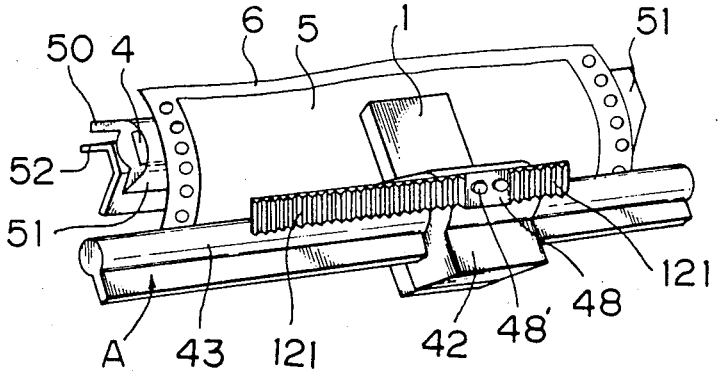
FIG. 13 shows the printing part of the apparatus according to the invention.

FIG. 13 is a detailed view of the thermal printing part of the printer shown in FIG. 6. The thermal head 1 is fixed to a carriage 42 which is mounted on a shaft 43. The carriage is slide movable along the shaft but no rotational movement about the shaft is allowed. A force intending to rotate the shaft 43 in the direction of arrow A is applied to the shaft by any suitable means which is not shown but may be, for example, a spring or solenoid. When such rotational force is applied to the shaft 43, the thermal head 1 is brought into pressure-contact with a pad 4 made of elastic material such as rubber through the double recording paper 5, 6. The carriage 42 can be moved by a belt 121 throughout the full width of the recording paper.

Figure 14:
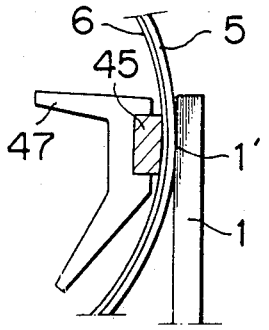
FIG. 14 is a cross section of the printing part according to the prior art.

FIG. 14 shows, in cross section, the structure of a prior art thermal printer. The heat generating portion 1' on the thermal head 1 is brought into press-contact with the pad 45 through the recording paper 5, 6. The pad 45 made of elastic material such as rubber is secured to a holder 47. When the surface of the pad 45 becomes inclined to the surface of the heat generating portion 1' of the thermal head 1, there is hardly obtained good print. However, it was technically difficult to attain a coincidence of the two surfaces throughout the full width of the recording paper. For this reason, hitherto, the pad 45 has been made of relatively thick rubber of low hardness so as to obtain good print also even when the surface is somewhat inclined to the heating surface. However, this solution involves the following disadvantages:

1. If the printer is left unused for a long time, then the surface of the rubber pad will be concaved at the portion where the head has continued to contact with the pad. After such concaved portion is once formed, no good print is obtainable at that portion.
2. Because of the low hardness of the rubber pad, the head sinks in the pad, which hinders a smooth movement of the carriage.
3. Since the pad is soft and thick, the recording paper is deformed by the thermal head so that a trace of running of the thermal head may be marked on the paper.

The present invention has solved the above problems and provides a thermal printer in which a thin rubber pad of relatively high hardness is used and which enables a good print to be obtained.

Figure 15:
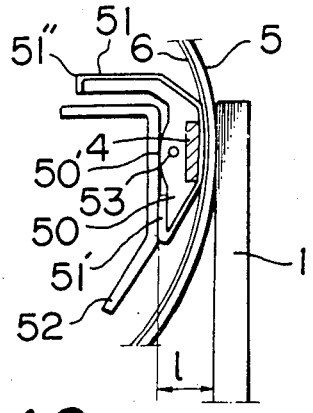
FIGS. 15 and 16 are cross sections of the printing part according to the invention.

FIG. 15 is a detailed view of the essential part of the embodiment shown in FIG. 13. The pad made of rubber 4 is fixed to a supporting member 50 held by a holder 52 which serves as a stopper against the rotational movement of the member 50. The holder is secured fixedly to the main body of the printer. The supporting member has an arcuate portion 50' at which the member 50 is in contact with the holder 52. The shaft 53 supports the member 50 rotatably about it. Therefore, the supporting member 50 can rotate about the shaft 53 until the rotation is stopped by the holder 52. The outside surface of the pad 4 is covered with a film 51 of heat resistant and low friction material such as Teflon. The film 51 is fixed to the supporting member 50 at the both ends 51' and 51'' by binder or the like while the central portion is left unfixed to absorb thermal deformation. The provision of such cover film 51 has the following advantage. Even when man forgets loading of common paper 6 and the ink on the backside surface of heat sensitive paper 5 is erroneously impressed on the surface of the pad, the mark of ink can be erased at once since Teflon or other similar material from which the cover film is made, has a surface lubricating property. On the contrary, if such erroneous printing is done on a rubber pad without such cover film, the mark of ink can hardly erased from the pad surface. In this case, the pad must be replaced by a new one.

Figure 16:
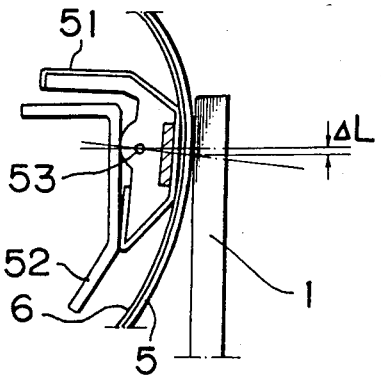

When the thermal head 1 is in a position apart from the pad 4, the latter may incline as shown in FIG. 16. But, when the head 1 is brought into contact with the pad through the recording paper 5, 6, the pad is easily returned to the position shown in FIG. 15. This is because in the position shown in FIG. 15, the distance (l) from the holder 52 to the head 1 becomes minimum. When the pad is shifted from the position shown in FIG. 16 to that shown in FIG. 15, the center of the pad 4 moves by $\Delta L$. The pad 4 slides relative to the backside surface of paper 6. The cover film 51 aids the pad to smoothly slide. The pad covered with a heat resistant and low friction film according to the invention is applicable to all other contact type heads with good effects. Furthermore, according to the invention there is produced no irregular contact pressure even when various recording papers having different thicknesses are used.

Figure 18:
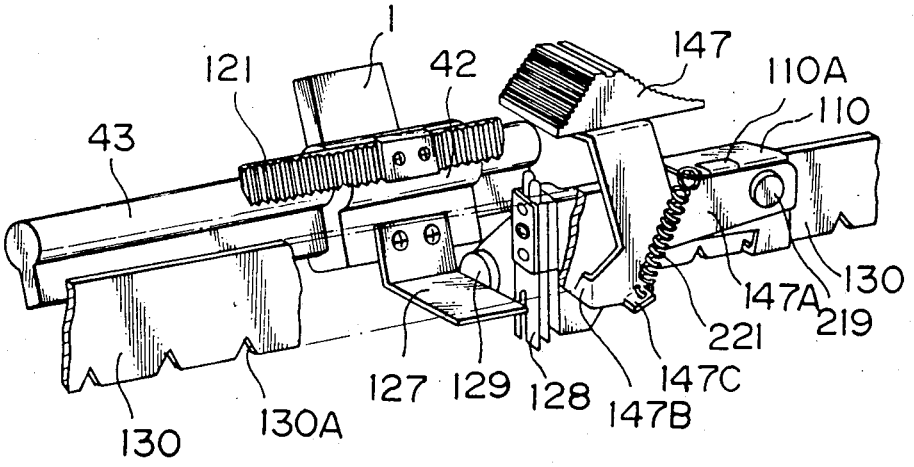
FIG. 18 is an enlarged view of the margin setting part of the printer shown in FIG. 17.
Figure 17:
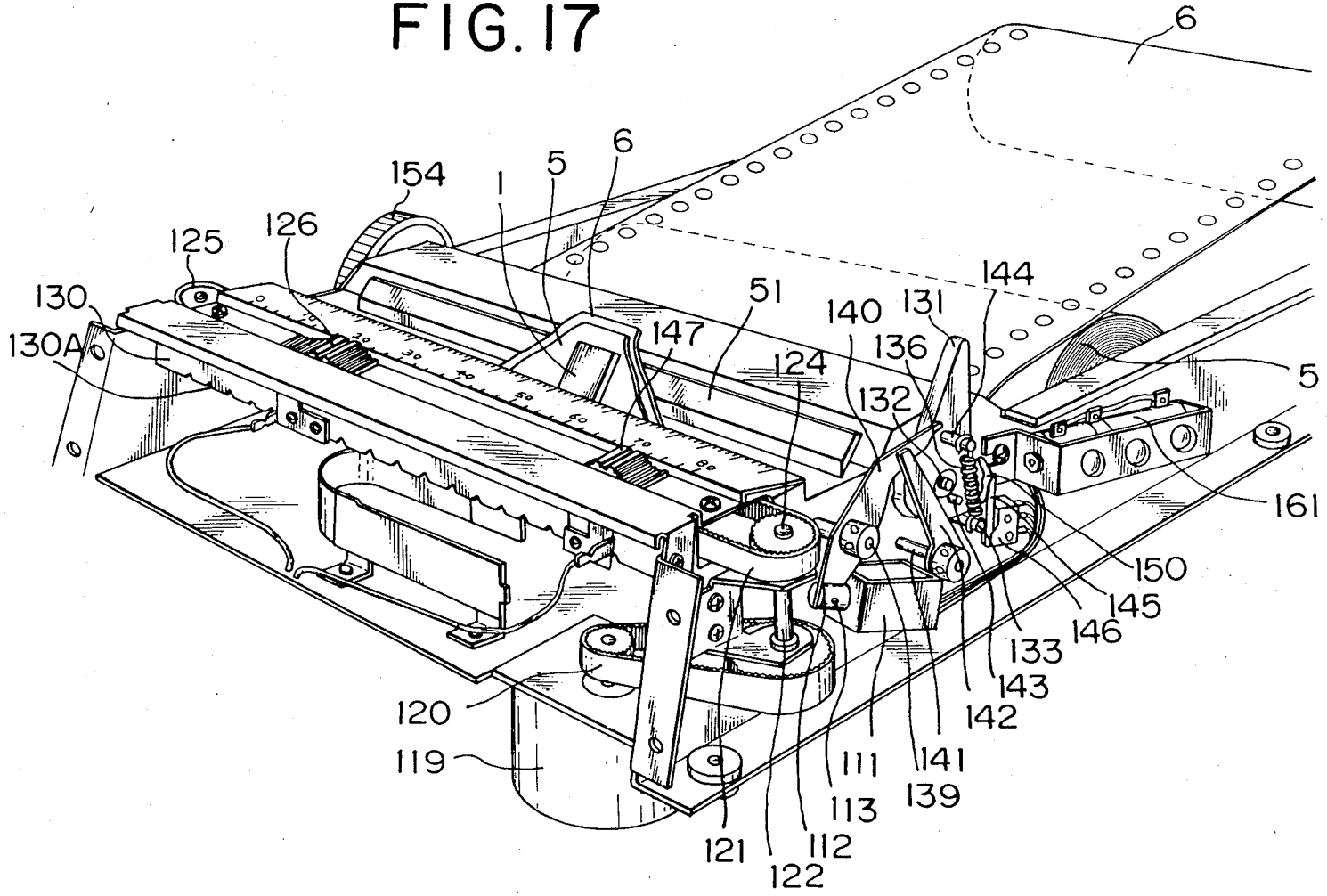
FIG. 17 shows one embodiment of the invention in perspective view and in detail.

FIG. 17 is a perspective view of the whole of a printer in which the present invention is embodied. FIG. 18 is a partial detailed view thereof. The thermal head 1, like the conventional one, is movable on and along the slide rail 43 (FIG. 18). Designated by 119 is a pulse motor for driving the carriage 42 on which the thermal head 1 is mounted. The driving power from the motor is transmitted to a shaft 122 through a belt 120. The shaft 122 has a pulley 124 fixed thereto and a belt 121 extends from the pulley 124 to an idle pulley 125. The belt 121 is connected with the carriage 42 in a manner as shown in FIG. 18. The pulse motor 119 is energized not only at the time of the carriage being driven but also at the time the carriage remains still. The reason why the motor is energized at the latter time is that the carriage must be kept in the stopped position by doing so. However, the electric current required for this purpose is smaller than that required to drive the carriage. Therefore, in this embodiment, the holding current is set only to 20–80% of the driving current. The resistance 161 shown in FIG. 17 is means for reducing the holding current. Printing start position and end position of the thermal head 1 are set by moving a setting mechanism 110 using knobs 126 and 147 respectively. The manner of setting of printing end position is described with reference to FIG. 18.

The carriage 42 has a piece of plate 127 fixed thereto and the setting mechanism 110 has a contact 128 which moves together with the mechanism. As the carriage moves, the piece of plate 127 comes into contact with the contact 128 and moves it to its ON-position. Thereby, an end of printing is detected. A further movement of the carriage rightward as viewed in the drawing makes a portion of the piece of plate 127 abut against a rubber damper 129 which prevents the carriage from further moving rightward. The rail 130 has a series of notches 130A and the knob 147 has a lever 147A integrally formed with it. Engagement of a click 147B of the lever 147A with one of the notches 130A locks the setting mechanism 110 in the set position. By pressing down the knob 147, the click is disengaged from the notch so that the setting mechanism 110 is allowed to move rightward or leftward up to any desired notch 130A. Leaving hold of the knob, the click 147B is engaged in the selected notch 130A to set a new end position.

Figure 19:
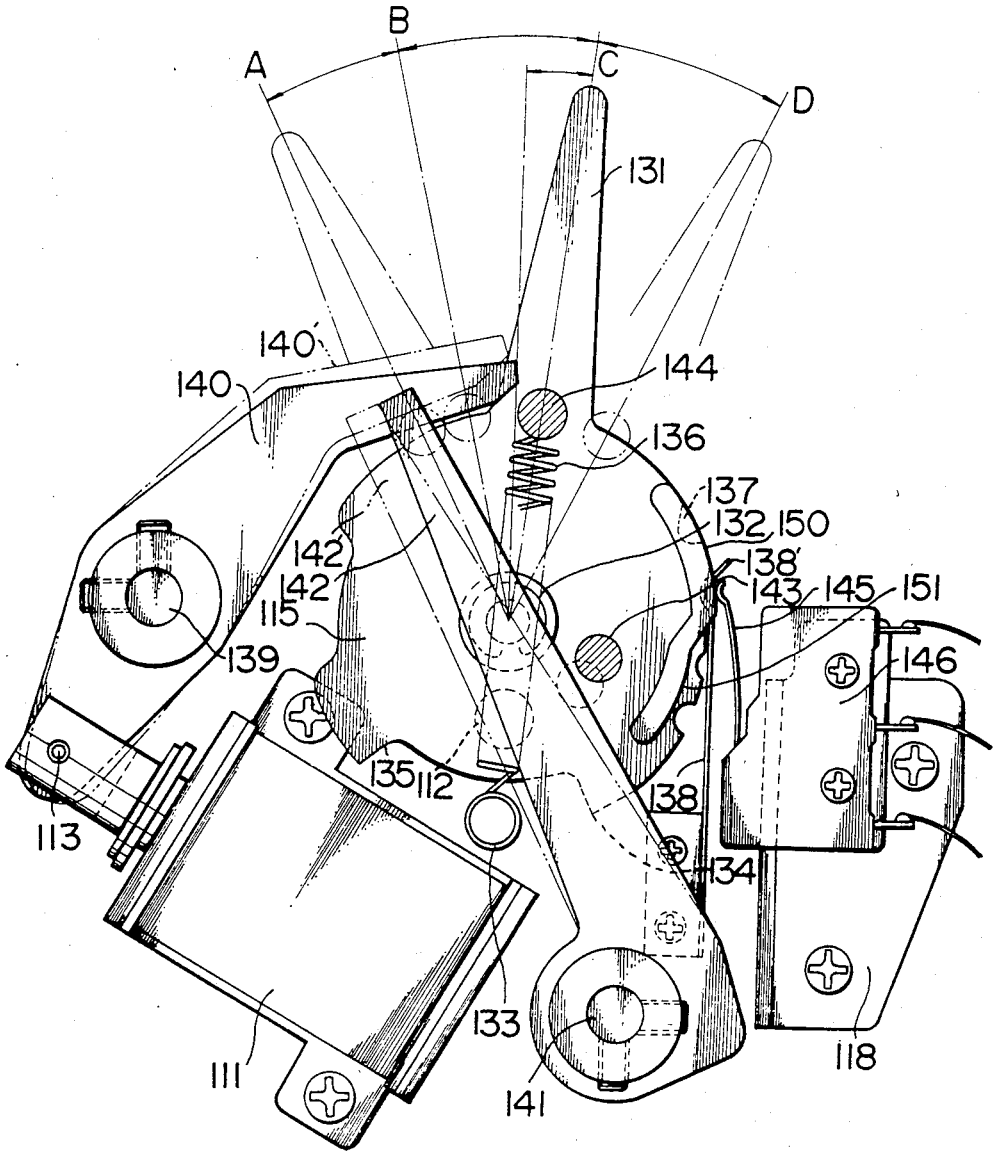
FIG. 19 shows the control lever portion thereof.

In FIG. 17, the reference numeral 131 designates a control lever which is swing movable about a fixed axis 132 within a predetermined range of rotational angle. This range is shown in FIG. 19 and from A to D. On the main body part 115 of the lever 131 there are formed two projections 135 and 134 which cooperate with a fixed shaft 133 to prevent the lever 131 from further rotating beyond the points A and D. To assist the lever in keeping its position at A or D, a spring 136 is disposed between the shaft 133 fixed to the printer body and a dowel 144 integrally formed with the lever 131. Between the two positions A and D there are two intermediate positions B and C. At these two intermediate positions B and C, the lever can not keep stable its position only by the force of the spring 136. But, the lever 131 has four notches 137 formed on the base part at the positions corresponding to A to D. A leaf spring 138 cooperates with the notches to hold the lever in any selected position of A, B, C and D. The leaf spring 138 is secured to the printer main body at its one end and the free end 138' of the spring can engage in any one of the four notches 137. Thus, at the positions A and D, the lever 131 is held in its position by a relatively large holding force and at the intermediate positions B and C it is held by a relatively weak holding force.

To push and retract the thermal head and the pinch rollers there are provided arms 140 and 142. The arm 140 for the thermal head is rotatably mounted on a shaft 139 whereas the arm 142 for the pinch rollers is rotatably mounted on a shaft 141. Provided in the vicinity of the control lever 131 is a microswitch 146. When On, the microswitch allows electric current to flow in the thermal head 1 and pulse motor 119. When Off it prevents the flow of current to the thermal head and pulse motor. On-Off of the microswitch 146 is controlled by the motion of a lever 145. The tip end of the lever 145 is in contact with a cam surface formed on the base part 115 of the above mentioned control lever 131. The cam surface comprises two cam portions, that is, high cam portion 150 and low cam portion 151. When the control lever 131 is set at A or B, the tip end of the lever 145 comes in the low cam portion 151 so as to turn the microswitch 146 off. At C or D it comes in the high cam portion 150 so as to turn the microswitch On.

Figure 20:
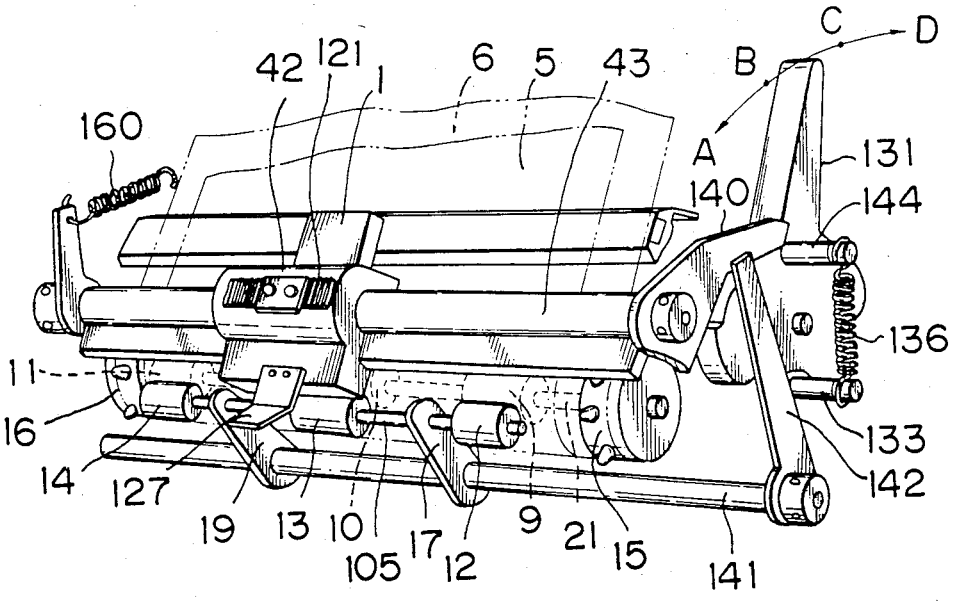
FIG. 20 shows the transmission system thereof and FIG. 21 shows a part of the control circuit thereof.

111 is a plunger which is actuated at the time of paper feeding. The plunger rotates the arm 140 counterclockwise so that the thermal head 1 is retracted from its working position on the record-paper so as to accommodate paper feeding. When the plunger 111 is turned off, the head 1 is again brought into press-contact with the recording paper (working position) by a spring 160 shown in FIG. 20. As seen best in FIG. 20, the thermal head 1 is mounted on a slide shaft 43 slide movable along the shaft and rotatable together with the shaft. The shaft 43 is always under the action of a spring 160 or a solenoid which biases the shaft to keep the head in press-contact with the recording paper 5, 6. Pinch rollers 12, 13, 14 are in contact with the rubber rollers 9, 10, 11 respectively through the recording paper under the action of springs 18 and 20 shown in FIG. 8. The pinch rollers are rotatable about the shaft 105 supported by the arms 17 and 19. The shaft 141 on which the arms 17 and 19 are fixedly mounted is rotatable. The above mentioned arm 140 is connected with the shaft 43 and the arm 142 is connected with the shaft 141 at one end thereof.

As previously noted, when the control lever is in the position of C, the head 1 and the pinch rollers 12, 13, 14 are in press-contact with the recording paper. But, when the control lever is rotated to the position A, the dowell 144 on the lever pushes the two arms 140 and 142 and moves them to the positions 140' and 142' suggested by phantom lines in FIG. 19 in this position of the arms, the thermal head and the pinch rollers are retracted apart from the recording paper. In this position, one can charge the printer with recording paper.

After charging of recording paper, one must again operate the control lever 131 to make the printer ready for printing. Namely, the control lever has to be returned to the position C or D in which the thermal head comes in contact with the platen.

However, an operator often forgets to return the control lever after charging of paper. In this case, the thermal head is left in air and can not contact with recording paper, pad or the like which has a good heat conductivity. Therefore, the radiation of heat becomes worse and the head is overheated thereby. If such overheating continues for a long time, then the effective life of the head is shortened to some extent. In the worst case, the head will be broken.

Figure 21:
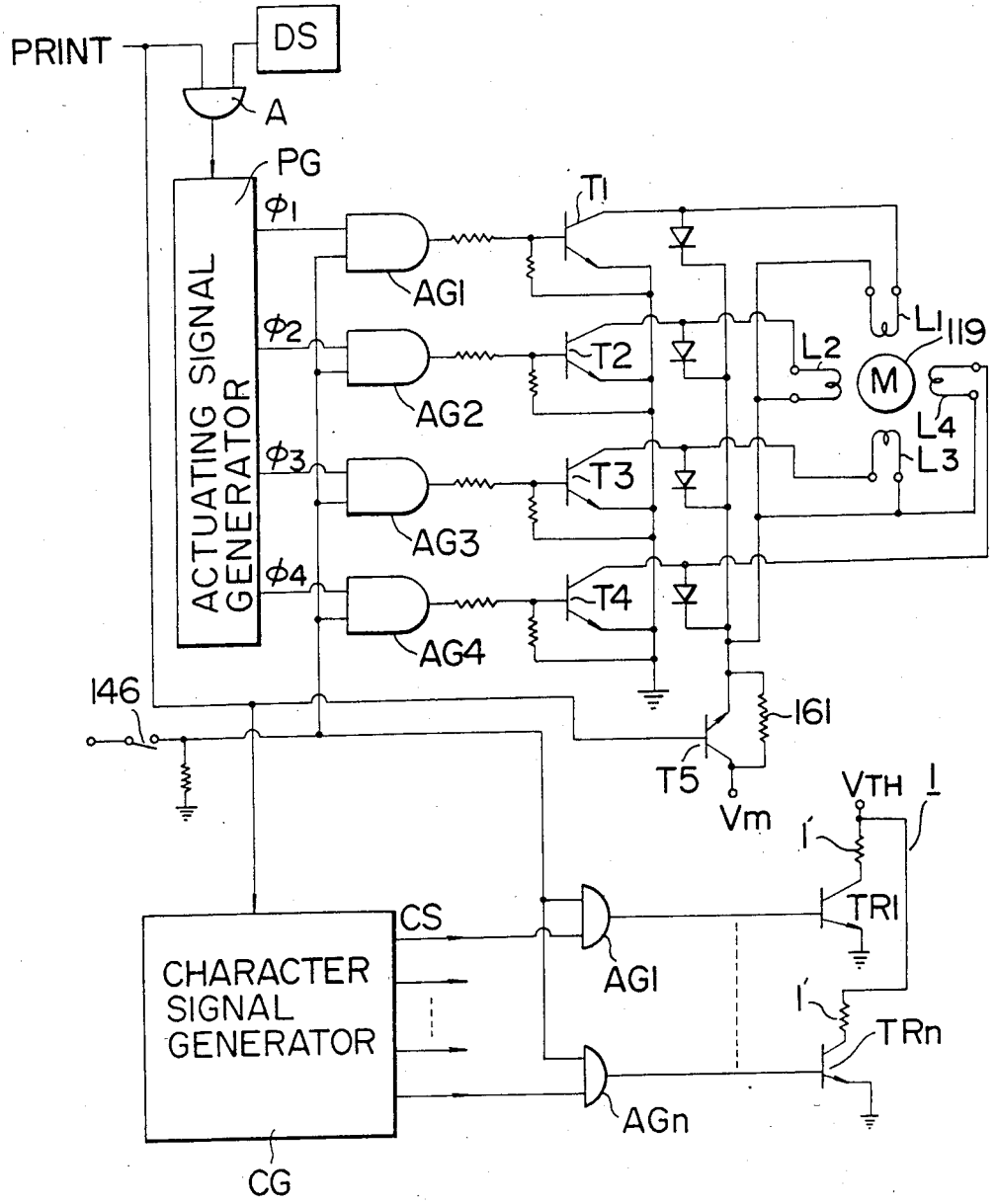

According to the invention, this problem is solved by using a control circuit as shown in FIG. 21. FIG. 21 is a block diagram of control circuit for controlling the pulse motor 119 and the thermal head 1 through On-Off of the microswitch 146.

In FIG. 21, PG is an actuating signal generator which produces pulse motor actuating signals $\phi_1$, $\phi_2$, $\phi_3$, $\phi_4$, in this order every time the output signal from a shift instruction signal generator DS passes through an AND-gate A. The actuating signal generator PG includes a built in ring counter. When the gate A is closed by $\overline{\text{PRINT}}$ signal, the counter is stopped. At this time, a predetermined actuating signal is continuously put out from the generator and transistor T5 is Off. Therefore, electric current can flow through the resistor 161. Thus, when the microswitch 146 is On, a holding current which is weak as compared with driving current flows through any one of coils L1–L4 so as to hold the carriage in its position. Individual signals from the actuating signal generator PG are applied to drive transistors T1–T4 through AND-gates AG1–AG4 respectively. As a result of sequential On-Off of these drive transistors T1–T4, exciting current flows in the pulse motor 119 so that the belt 121 runs to move the carriage 42 with the head 1. In this manner, printing is effected.

The above mentioned exciting current is controlled using an AND-gate AG 5 which is opened and closed by On and Off of the microswitch 146 and the output of which is introduced into the gates AG1–AG4. More particularly when the microswitch 146 is opened, a low level signal is applied to the AND-gates AG1–AG4. Therefore, these AND-gates are closed independently of the outputs $\phi_1$, $\phi_2$, $\phi_3$, $\phi_4$ from the actuating signal generator PG. Then, T1–T4 become Off and supply of exciting current to the pulse motor 119 is stopped.

CG is a character signal generator. Character signals CS generated from the generator CG in response to PRINT instruction are applied selectively to transistors TR1–TRn through AND-gates AG1–AGn to selectively drive thermal elements 1' of the thermal head. When the thermal head is in the retracted position apart from the recording paper, no thermal element 1' can be driven by the character signal CS. Since On-Off signal of the microswitch 146 is applied to AND-gates AG-1–AGn and, when the thermal head is in the retracted position, the switch 146 is Off, the AND-gates are closed. Therefore, any erroneous driving of the thermal head can be prevented.

When the control lever 131 is set to A, B, C or D, the printer operates in the following manner:

Position A

The dowel 144 formed integrally with the control lever 131 moves the arms 140 and 142 up to the positions 141' and 142'. In this position, the thermal head 1 as well as the pinch rollers 12, 13, 14 are retracted from the recording paper. Therefore, this position is suitable for carrying out charging of paper. As previously described, the microswitch 146 is Off in this position and the AND-gates AG1–AGn are closed. Therefore, there is no fear of the thermal head being overheated even when one erroneously gives a print instruction to the printer. In this position, AND-gates AG1–AG4 are also closed and no coil of the pulse motor 119 can be excited. The carriage can be moved at will. Therefore, the print start position and end position setting mechanism can be moved very easily irrespective of the position in which the carriage is at that time. However, since the recording paper is in a free state, it is apt to move accidentally in this position. For that reason, this position is unsuitable for shifting the print start and end positions. The position provided for this purpose is the next position, that is, position B.

Position B

In this position, the dowel 144 is out of contact with the arm 142 and therefore the pinch rollers 12, 13, 14, are in contact with the recording paper under pressure. Except for this point, the manner of operation in this position corresponds to that in the above described position A. This position B is most suitable for setting or changing the print start and end positions since the recording paper is unmovably pressed against the rubber rollers 9, 10, 11 by the pinch rollers 12, 13, 14. On the other hand, the carriage 42 can be moved very easily since the pulse motor 119 is not excited and the thermal head 1 is retracted from the recording paper in this position. Therefore, for example, by moving the knob 147 leftward while pressing it down, the piece of plate 127 attached to the carriage 42 can be easily moved with its one side contacted and pushed by the damper 129. In this position, the knob 47 can be moved at will irrespective of the position of the carriage. It is unnecessary to preliminarily move the carriage 42. This is applicable to another knob 126.

Position C

This position is to be used when printing is carried out on the double recording paper according to the invention mentioned above. In this position, the dowell 144 can contact with neither of the arms 140 and 142. Therefore, the thermal head 1 and the pinch rollers 12, 13, 14 are in contact with the recording paper 5, 6 under pressure. On the other hand, since the microswitch is turned On by the cam portion 50, both the thermal head 1 and the pulse motor 119 can receive electric current. This position is also useful where an ordinary heat sensitive paper having no ink layer on the back side surface is used alone.

Position D

This position is to be used when such heat sensitive paper is employed which is provided with pin feed perforations.

As previously described, three rubber rollers 9, 10, 11 disposed in the central area of paper feeding part are used to feed both of papers 5 and 6. Further, two sprocket rollers with pins 15 and 16 are provided, one being outside of the rubber roller 9 and another outside of the rubber roller 11. These two rollers are pin rollers used to feed the web of recording paper 6 provided with pin feed perforations along both sides as mentioned above. However, if conventional perforated heat sensitive paper alone is used, then it is preferrable to keep the pinch rollers 12, 13, 14 out of contact with the perforated heat sensitive paper. This is because papers coated with chemicals including the above mentioned heat sensitive paper, in general, have a high expansion or shrinkage under the action of temperature and moisture. Sometimes, the amount of paper fed by the rubber rollers 9, 10, 11 and that by the sprocket rollers 15, 16 for the same time length have a considerable difference which may result in breaking of the heat sensitive paper at the perforations.

As seen in FIG. 19, in the position D the dowel 144 is much more spaced from the arm 142 than in the position C. But, the control lever 131 has one more dowel 143 provided on the lever base portion 115. In the position D, this second dowel 143 pushes the arm 142 to the position 142'. Therefore, pinch rollers 12, 13, 14 are in their retracted positions while the arm 140 and microswitch 146 remain in the same positions as in position C.

Operations in A to D described above are summarized in the following table, Table 1.

TABLE 1

| | Pinch rollers | Motor, head driving circuit | Micro-switch | Head Position |
|---|---|---|---|---|
| A. Paper charge | retracted | cut off | Off | retracted |
| B. Setting of print start and end positions | contacted | cut off | Off | retracted |
| C. Printing on a combination of perforated common paper and heat sensitive paper coated with ink or common heat sensitive paper alone | contacted | connected | On | contacted |
| D. Printing on perforated heat sensitive paper | retracted | connected | On | contacted |

Generally speaking, pressure of pinch rollers and pressing force of head in a thermal printer are relatively large. Therefore, in positions A and D where a reaction force is applied to the control lever 131 by the arm 142, a large holding force is required. As previously noted, in the printer according to the invention, the holding force in positions A and D is increased by the spring 136. There is no problem in this respect.

In position B, a reaction force is applied to the dowel 144 by the arm 140. But, in this case, the force works in the direction toward the center axis 132 of the control lever 131. Therefore, it is not concerned with the holding force.

In case one charges the printer with perforated recording paper, it can be carried out in the following procedure. At first, the control lever 131 is brought to position A. Then, the perforations of the recording paper are engaged with the pins of the sprocket rollers while rotating the manual paper feeding knob 154.

Now, description will be made of margin setting mechanism for determining the range in which characters can be printed.

Figure 22:
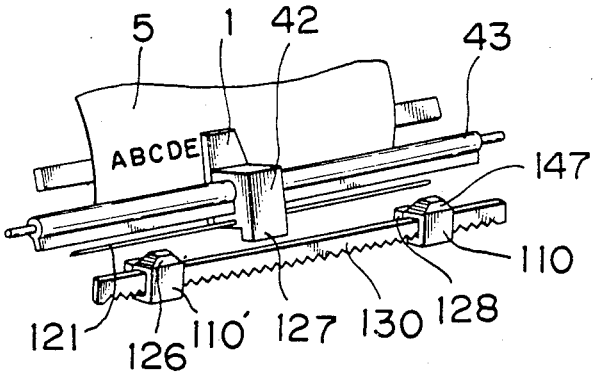
FIG. 22 shows margin setting means according to the prior art.

A typical example of printer provided with margin setting means is shown in FIG. 22.

In FIG. 22, the head carriage 42 with a printing head 1 mounted thereon is slide movable along a slide shaft 43 and is driven by a head driving motor (not shown) through a wire 121 so as to print characters successively on a recording paper 5.

Margin setting means comprise a margin set carriage 110 and a head position detector 128 mounted on the carriage 110. The margin set carriage is slide movable along a guide rail 130 and can be locked at any desired position on the guide rail by click means. As the head position detector 128 there may be used a contact type switch such as spring contact switch, microswitch and the like. When such contact type switch is used, the position of printing head 1 is detected by making a projection 127 of the head carriage 42 contact with the detector. Therefore, margin setting means must be designed to satisfy the requirements that it can be moved as desired and that during the normal operation of the printer it can not be detached from the guide rail or can not be moved unintentionally.

For one unit of printer, two margin setting means are provided, one for detecting the print start position and another for detecting the print end position. In FIG. 22, margin setting means 126 at the left hand side as viewed in drawing is that for detecting the start position and margin setting means 147 at the right hand side is that for detecting the end position. These two margin setting means are entirely the same in structure and shape, and they are usually positioned symmetrically relative to the center of the guide rail. Therefore, hereinafter, description will be made in detail as to only the right hand margin setting means.

Figure 23A:
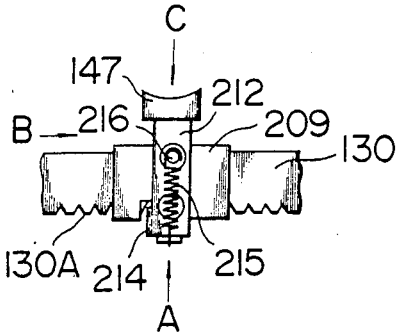
FIGS. 23 (A) and 23 (B) are partial enlarged views thereof.
Figure 23B:
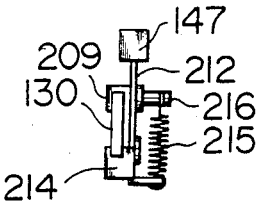

The structure of margin setting means according to the prior art is shown in detail in FIG. 23.

In FIG. 23, a margin set carriage designated by 209 has a movable lever 212. The lever 212 has a fixed knob 147 at its upper end and a fixed stopper 214 at its lower end. A coil spring 215 extends from a pin 216 fixed on the carriage 209 to the lower free end of the lever 212. Normally the lever 212 is biased by the coil spring 215 in the direction of arrow A. Under the action of this spring force, the stopper 214 is in engagement with one of notches 130A provided on the under side of the guide rail 130. Through this engagement, the margin set carriage is locked at a desired position on the rail. Therefore, the margin set carriage 209 can be hardly moved by impact of the head carriage 42.

When one wishes to shift the position of the margin set carriage 209 to another position, he pushes the knob 147 by hand in the direction of arrow C to disengage the stopper from the notch and then moves the carriage 209 along the rail.

The above described conventional margin setting means has a disadvantage that it is not easy to operate.

Even when the margin set carriage 209 at the right hand side is intended to be moved leftward, one must push the knob 147 down at first in the direction of arrow C and then move the carriage along the rail 130. This is troublesome.

The present invention eliminates the above disadvantage and provides margin setting means which are easy to operate and which are hardly moved by the impact of the head carriage during normal operation of the printer.

Figure 24A:
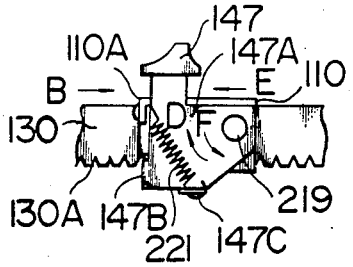
FIGS. 24 (A) and 24 (B) are views similar to FIGS. 23 (A) and (B) but showing margin setting means according to the invention.
Figure 24B:
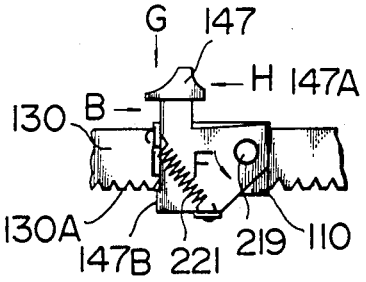

An embodiment of margin setting means according to the invention is shown in FIG. 24.

In FIG. 24, a right side margin set carriage 110 has a lever 147A. The lever is swing movable about a pivot 219 fixed to the carriage 110. A coil spring 221 is disposed between an angle 110A fixed on the carriage 110 and an angle 147C provided on the lever 147A. Normally, the coil spring 221 applies to the lever 147A a moment in the direction of arrow D. Therefore, a stopper 147B provided at the lower end of the lever is normally in engagement with one of the notches 130A.

When a force working in the direction of arrow B is applied to the right side margin setting carriage 110 by the head carriage 42, a further moment in the direction of D will act on the lever 147A. Thereby, the engagement of the carriage 110 with the guide rail 130 is enhanced and never loosened. Therefore, the carriage 110 remains locked against the impact by the head carriage.

On the contrary, when a force in the direction of arrow E is applied to the margin set carriage 110, a moment in the direction of arrow F acts on the lever 147A and therefore the stopper 147B is disengaged from the notch 130A so that the carriage can be moved in the direction of arrow E.

Also, when the knob 147 is pushed down in the direction of arrow G, a moment in the direction of arrow F acts on the lever 147A and the stopper 147B is disengaged from the notch 130A. Therefore, the carriage 110 can be moved along the guide rail 130.

With the structure described above, the margin set carrige 110 is hardly moved by the impact caused by the head carriage 42 when the projection 127 thereof comes into contact with the detector 128 on the margin set carriage 110 during printing operation. Thus, a correct detection of the print end position is always assured.

When the range of character printing has to be broadened, it can be done by pushing the knob 147 down in the direction of G at first and then moving it in the direction of B. On the contrary, when one wishes to narrow the range, it can be done only by moving the knob 147 in the direction of arrow H without pushing it down, in a simple manner and with less force.

Recently, with the increase of variety of information, there has been an increasing desire to use various kinds of recording papers having different widths in a single printer.

To satisfy the desire, such printer has been developed which is provided with paper guide means shiftable according as the width of recording paper then used. In this case, since the printing range varies with widths of papers, it is necessary for the printer to be provided with margin setting means in addition to the paper guide means.

Usually, margin setting means and paper guide means are so designed as to operate independently of each other. Therefore, there is such possibility that a margin may be set beyond the width of recording paper then used. If such erroneous setting is done, the printing head will go beyond the side edge of paper and print characters on an area where no recording paper is present. It is known that such vain printing (false printing) is one cause of printer trouble. Besides, it has a considerable adverse effect on the life of the printing head, in particular, in a printer of the type in which the printing head is always in contact with recording paper, such as a heat sensitive type printer or discharge type printer.

The present invention has solved the above problem. According to the invention, margin setting means can not go beyond paper guide means and the printing head moves always within the range of breadth of recording paper used at that time but a margin can be set at will within the limit determined by the paper breadth.

An embodiment of the invention will be described with reference with FIGS. 25 and 26.

Figure 25:
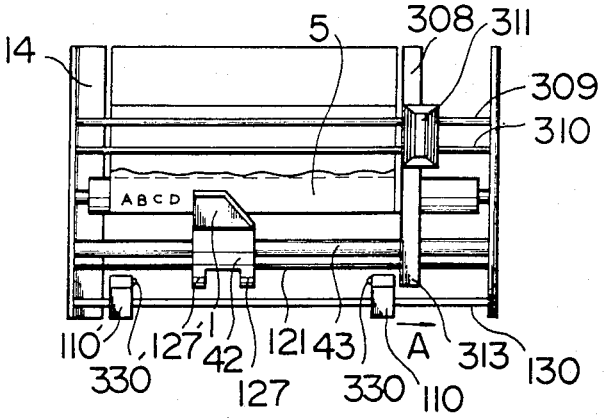
FIGS. 25, 26 and 27 show other embodiments of the invention.

In FIG. 25, a printing head is again designated by 1 and a head carriage by 42. The carriage 42 with the printing head 1 is slide movable along a slide shaft 43 and is driven by a head driving motor (not shown) through a wire 121.

Margin setting means comprise two head position detectors 330 and 330' of which one is at the right hand side and the other at the left hand side. Both detectors are slide movable along a guide rail 130 and can be locked at selected positions in the manner described before.

The left side detector 330' detects the print start position of the printing head whereas the right side detector 330 detects the print end position of the printing head and produces a carriage return signal. As the band position detectors 330, 330', there may be used a spring contact switch, microswitch, lead switch, hole element switch or photo coupler.

Paper guide means comprise a paper guide 308 which is slide movable along two guide rails 309 and 310. The position of the paper guide is selected according to the width of recording paper to be used and setting of the position can be done by moving the knob 311 of the paper guide by hand.

The paper guide 308 has a stopper 313 to prevent the right side head position detector 330 from moving on in the direction of arrow A beyond the width of the recording paper 5.

Figure 26:
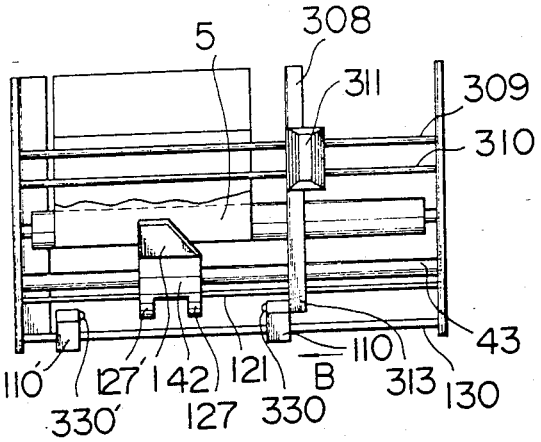

When a narrower recording paper 5 is used, the paper guide 308 is moved in the direction of arrow B as shown in FIG. 26. At this time, the right side head position detector 330 is also moved in the direction of arrow B by the stopper 313. Therefore, when the paper guide 308 has been set at a proper position, there is automatically obtained also a new printing range adapted to the new narrower recording paper 5. If it is wished to further narrow only the printing range for the same recording paper, it can be accomplished by moving the right side head position detector 330 alone in the direction of arrow B.

With the above described arrangement, the right side head position detector 330 is kept within the range of the width of the recording paper then used whatever width it may have. Therefore, it never happens that the printing head goes beyond the width of the recording paper. Thus, the above mentioned problem of false printing is completely eliminated. This reduces problems of the printing head and platen and also lengthens the life of the printing head.

Figure 27:
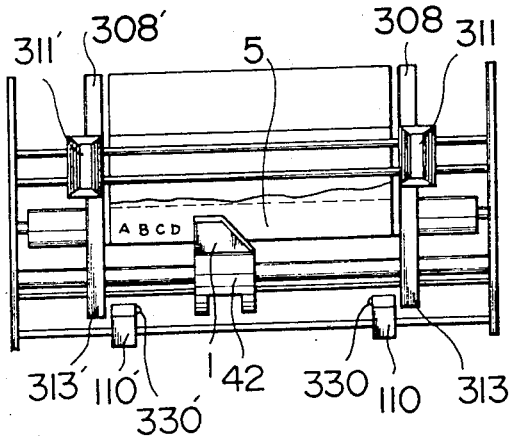

FIG. 27 shows a modification of the above described embodiment. In this modification, one more paper guide 308' is provided at the left hand side, in addition to the paper guide 308 at the right hand side. The two paper guides 308 and 308' are entirely the same in form and structure. By using two paper guides, the printer can be used more conveniently.

While the invention has been particularly shown and described with reference to preferred embodiments thereof, it will be understood by those skilled in the art that the foregoing and other changes in form and details can be made therein without departing from the spirit and scope of the invention.

What we claim is:

1. A thermal printer, comprising:

a thermal head movable between a first position for engaging a recording medium and a second position for disengaging the recording medium, wherein the first and second positions are disposed along a direction crossing a plane of the recording medium;

manual operation means for manually changing the position of said thermal head between the first and second positions;

driving means for driving said thermal head for generating heat;

moving means for reciprocally moving said thermal head along the recording medium said manual operation means being operable at any point in the movement of said thermal head along the record medium;

detecting means for detecting the position of said thermal head; and inhibiting means for inhibiting operation of said driving means and said moving means in response to said detecting means.

2. A thermal printer according to claim 1, further comprising a plurality of pinch rollers which are brought into retracted positions to accommodate loading of a recording medium when said thermal head is in the second position.

3. The thermal printer according to claim 1, further comprising means for feeding said recording medium, wherein the heat generation of said thermal head is inhibited by said inhibiting means when the recording medium is being fed by said feeding means.

* * * * *